US006088960A

United States Patent [19]

Hartzog

[11] Patent Number: 6,088,960

[45] Date of Patent: Jul. 18, 2000

[54] CHRISTMAS TREE SAFETY DEVICE

[76] Inventor: Lizabeth M. Hartzog, 5 Poplar Way, Arden, N.C. 28704

[21] Appl. No.: 09/036,516

[22] Filed: Mar. 6, 1998

[51] Int. Cl.[7] ..... A47G 7/02; G08B 21/00

[52] U.S. Cl. ..... 47/65.5; 47/40.5; 340/620

[58] Field of Search ..... 47/40.5, 79, 48.5, 47/65.5; 340/618, 620, 622

[56] References Cited

U.S. PATENT DOCUMENTS

| | | | |
|---|---|---|---|
| 4,284,878 | 8/1981 | Bartels | 392/403 |
| 4,796,017 | 1/1989 | Merenda | 340/620 |
| 4,825,587 | 5/1989 | Stancil | 47/40.5 |
| 4,930,252 | 6/1990 | Krause et al. | 47/40.5 |
| 5,054,236 | 10/1991 | Sands | 47/79 |
| 5,410,839 | 5/1995 | Granger | 47/40.5 |
| 5,428,348 | 6/1995 | Gault | 340/618 |
| 5,493,277 | 2/1996 | Pierce et al. | 340/620 |
| 5,513,677 | 5/1996 | McCurry | 141/1 |
| 5,615,516 | 4/1997 | Brown | 47/40.5 |
| 5,799,437 | 9/1998 | Evans et al. | 47/40.5 |
| 5,809,691 | 9/1998 | Frantz | 47/40.5 |
| 5,867,929 | 2/1999 | Jung et al. | 47/40.5 |

FOREIGN PATENT DOCUMENTS 2659214 9/1991 France .

*Primary Examiner*—Peter M. Poon
*Assistant Examiner*—Yvonne R. Abbott
*Attorney, Agent, or Firm*—Joseph T. Guy, Jr.

[57] ABSTRACT

Described and claimed is a safety device for determining and reporting an amount of water in a reservoir of a potted plant. The safety device comprises a probe in the reservoir. The probe comprises a low water detector capable of providing a first electrical signal when the reservoir has a water level below the low water detector and a high water detector capable of providing a second electrical signal when the reservoir has a water level above the high water detector. The safety device further comprises an ornament comprising a low water indicator capable of receiving the first electrical signal and illuminating and a high water indicator capable of receiving the second electrical signal and illuminating.

14 Claims, 3 Drawing Sheets

CHRISTMAS TREE SAFETY DEVICE

BACKGROUND OF THE INVENTION

This invention relates generally to a device which alerts to the water level in a cut plant, and more particularly to an improved method for maintaining the appropriate water level in a Christmas tree support.

It is well known to support Christmas trees, or similar plants, in a stand with a water reservoir. The water reservoir must be refilled periodically to replenish the water which is absorbed by the tree or evaporates.

Automatic replenishing systems are taught in U.S. Pat. Nos. 4,825,587 and 4,930,252. These comprise a large water reservoir, a pumping system and a electromechanical detector system in the water reservoir. Electromechanical monitoring systems can become inefficient when salts and minerals build up in the water reservoir and are therefore not desirable for long term use.

U.S. Pat. No. 5,410,839 teaches a water funnel system with a mechanical float to alert when the water level is at a maximum. The user is not alerted to a low water condition and therefore must continually check the water level.

There has been a long felt need in the art for a safety device which will alert if the water level in the reservoir is too low and which will inform the user when the water is maximized thereby avoiding spillage.

SUMMARY OF THE INVENTION

It is an object of the present invention to provide a safety device for a potted plant which is capable of alerting when the water level is low and when the water level is high.

It is a particular object of the present invention to provide a safety device which is not visually obtrusive.

A particular feature of the present invention is the appearance which is similar to an decorative ornament.

These and other advantages are provided in a safety device for determining and reporting an amount of water in a reservoir of a potted plant. The safety device comprises a probe in the reservoir. The probe comprises a low water detector capable of providing a first electrical signal when the reservoir has a water level below the low water detector and a high water detector capable of providing a second electrical signal when the reservoir has a water level above the high water detector. The safety device further comprises an ornament comprising a low water indicator capable of receiving the first electrical signal and illuminating when the first electrical signal is received and a high water indicator capable of receiving the second electrical signal and illuminating when the second electrical signal is received.

An embodiment of the present invention is provided in a safety device for determining and reporting an amount of water in a reservoir of a potted plant. The safety device comprises a probe in the reservoir. The probe comprises an elongated tube; a low water detector attached to the tube and capable of providing a first electrical signal when the reservoir has a water level below the low water detector and a high water detector attached to the tube and capable of providing a second electrical signal when the reservoir has a water level above the high water detector. An ornament is provided which comprises a low water light and a high water light. Electrical connectivity is provided by a first electrical control element capable of receiving the first electrical signal and illuminating the low water light and a second electrical control element capable of receiving the second electrical signal and illuminating the high water light.

Another embodiment of the present invention is provided in a safety device for a potted plant comprising a reservoir for holding an amount of water; an electrical control element; and a probe. The probe comprises an elongated tube with a bottom end and a top end. A first disk is attached to the tube between the bottom end and the top end. A first detector is attached to the first disk and a first lead connects the first detector to the electrical control element. A second disk is attached to the tube between the first disk and the top end. A second detector is attached to the second disk and a second lead connects the second detector to the electrical control element. A grounding element is attached to the bottom end of the tube between the first disk and the bottom end with a third lead connecting the grounding element to the electrical control element. The safety device further comprises an ornament comprising a first light in electrical connection with the electrical control element and a second light in electrical connection with the electrical control element. If the amount of water in the reservoir is sufficient to immerse the first detector and the grounding element the first light extinguishes. If the amount of water in the reservoir is sufficient to immerse the second detector and the grounding element the second light illuminates.

DETAILED DESCRIPTION OF THE INVENTION

Throughout the following description similar elements are numbered accordingly.

Figure 1:
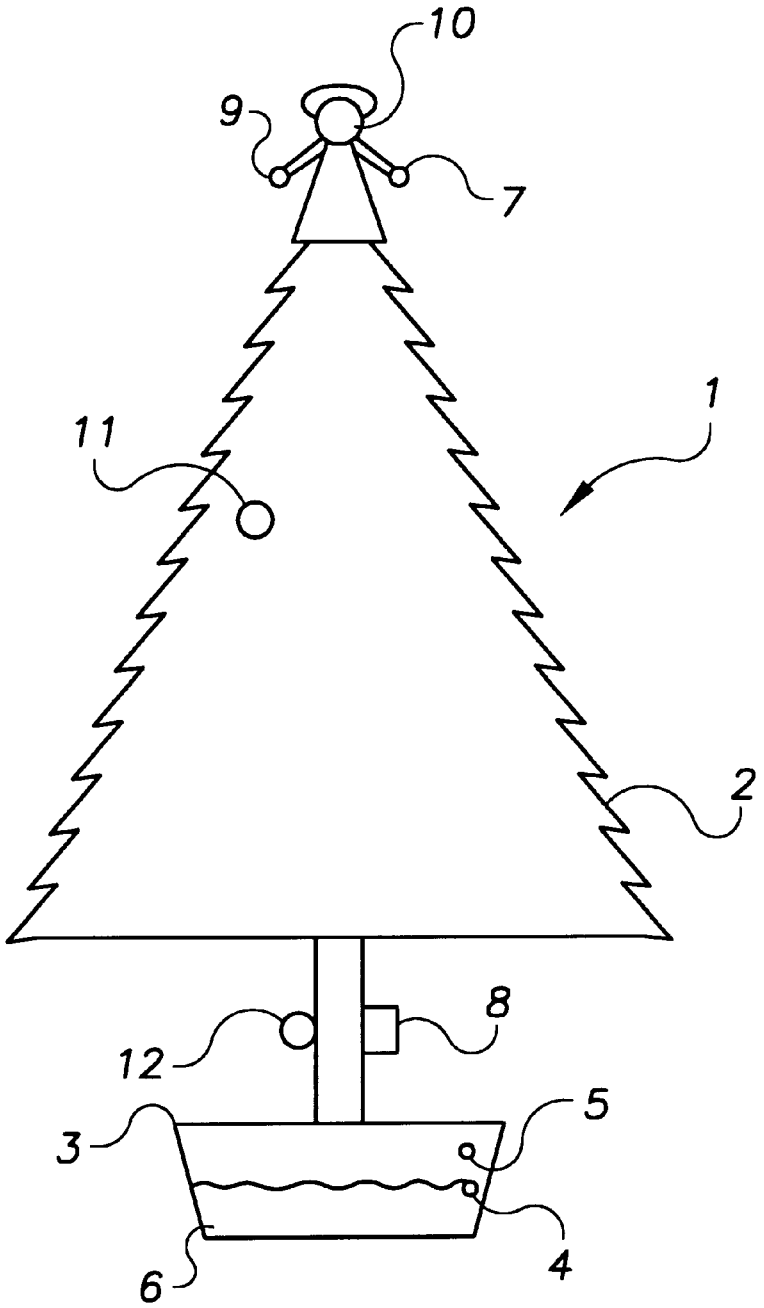
FIG. 1 is a partial cross-sectional schematic view illustrating the elements of one embodiment of the present invention.

Referring to FIG. 1, the inventive safety device as used with a potted plant is represented generally at 1. The tree, 2, is supported in a stand, 3, which is capable of holding water, 6. In the lower extent of the stand is a low water detector, 4, which provides a signal unless the low water detector is immersed. The low water detector, 4, is connected electrically, as described herein, to a electrical control element, 8, which is, in turn, connected electrically to a low water indicator light, 7. The low water indicator light, 7, is integral to an ornament, 10. If the water evaporates, or is taken up by the tree, in an amount sufficient to cause the level to go below the low water detector, 4, the low water indicator light, 7, illuminates. In the upper extent of the stand, 3, is a high water detector, 5, which provides a signal if immersed. The high water detector, 5, is connected electrically to the electrical control element, 8, which is in turn connected electrically to a high water indicator light, 9. The high water indicator light, 9, is integral to the ornament, 10. If the water level is increased to the level where the high water detector, 5, is immersed the high water indicator light, 9, is illuminated. An optional heat sensor, 11, is connected electrically to the electrical control element, 8, which is connected electrically to an alerter, 12. The alerter, 12 is preferably an audible alerter such as a siren or buzzer.

By simple visual inspection of the ornament, 10, an indication of water level can be determined. If the low water indicator light is extinguished the water level is sufficient. If the low water indicator light is illuminated water needs to be added to the stand. When water is added the high water detector, and high water indicator light provide a visible indication when the water level is at the maximum. The high water detector, 5, is placed in a position to avoid over filling the stand. The optional heat sensor provides another level of protection and insures that the tree does not get to warm thereby becoming a fire hazard.

Figure 2:
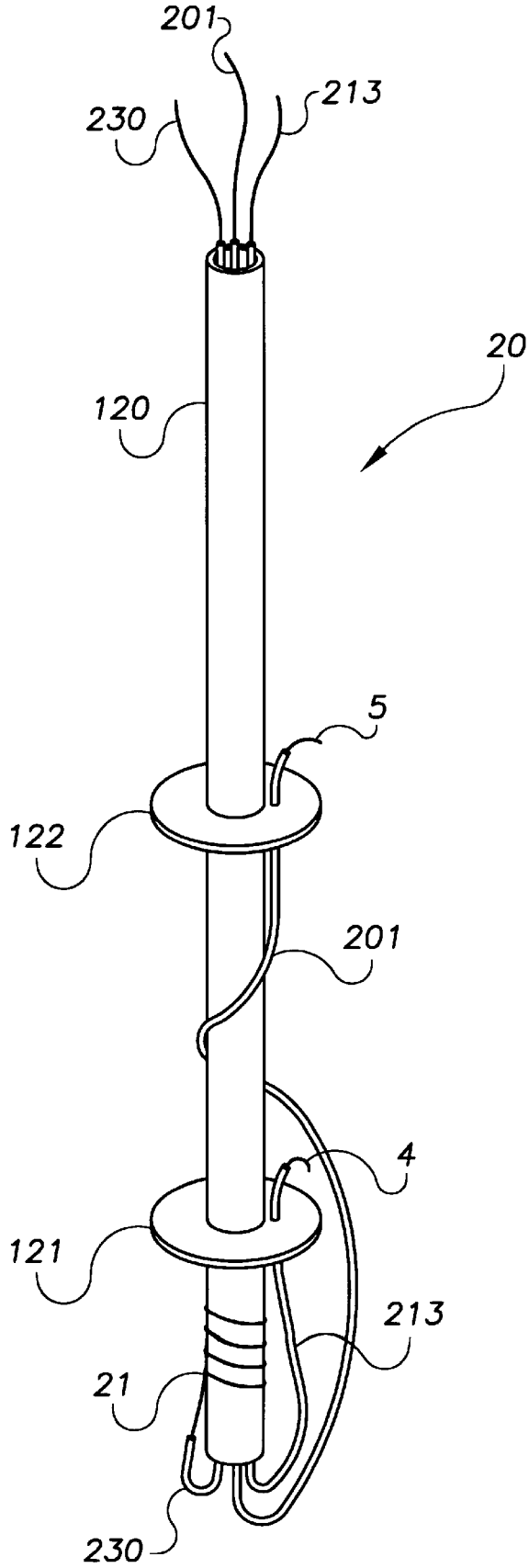
FIG. 2 illustrates a preferred probe of the present invention.

FIG. 2 illustrates a preferred probe, 20. The probe comprises an elongated tube, 120, with leads 201, 213, and 230 passing through the tube, entering the top end and exciting the bottom end. The tube is preferable semi-rigid with enough flexibility to not be brittle yet stiff enough to stand without collapsing from the weight of the tube and associated elements attached thereto. A first disk, 121, and second disk, 122, slibably receive the tube, 120, and are slidably attached to the tube. The second disc, 122, is situated between the first disk and the top end of the tube. Connected to the first disk, 121, is lead, 213, which is an insulated wire. The end of the lead, 213, is stripped of the insulation yielding a bare copper wire which is the low water detector, 4. Similarly, connected to the second disk, 122, is lead, 201, which is an insulated wire. The end of the lead, 201, is stripped of the insulation yielding a bare copper wire which is the high water detector, 5. In a similar manner the lead, 230, is an insulated wire the end of which is removed to expose a bare copper wire which forms the grounding terminal, 21. The first disk and second disk can be slid along the tube to alter range between the low water and high water levels.

The probe operates by electrical conductivity. If the low water detector, 4, and the grounding terminal, 21, are immersed in a common water reservoir the presence of dissolved salts allows electrical current to flow between the low water detector and the grounding probe. The electrical current flow opens the circuit thereby extinguishing the low water indicator. Similarly, if the high water detector, 5, and grounding terminal, 21, are immersed in a common water reservoir the circuit containing the high water indicator is closed and the high water indicator illuminates.

Figure 3:
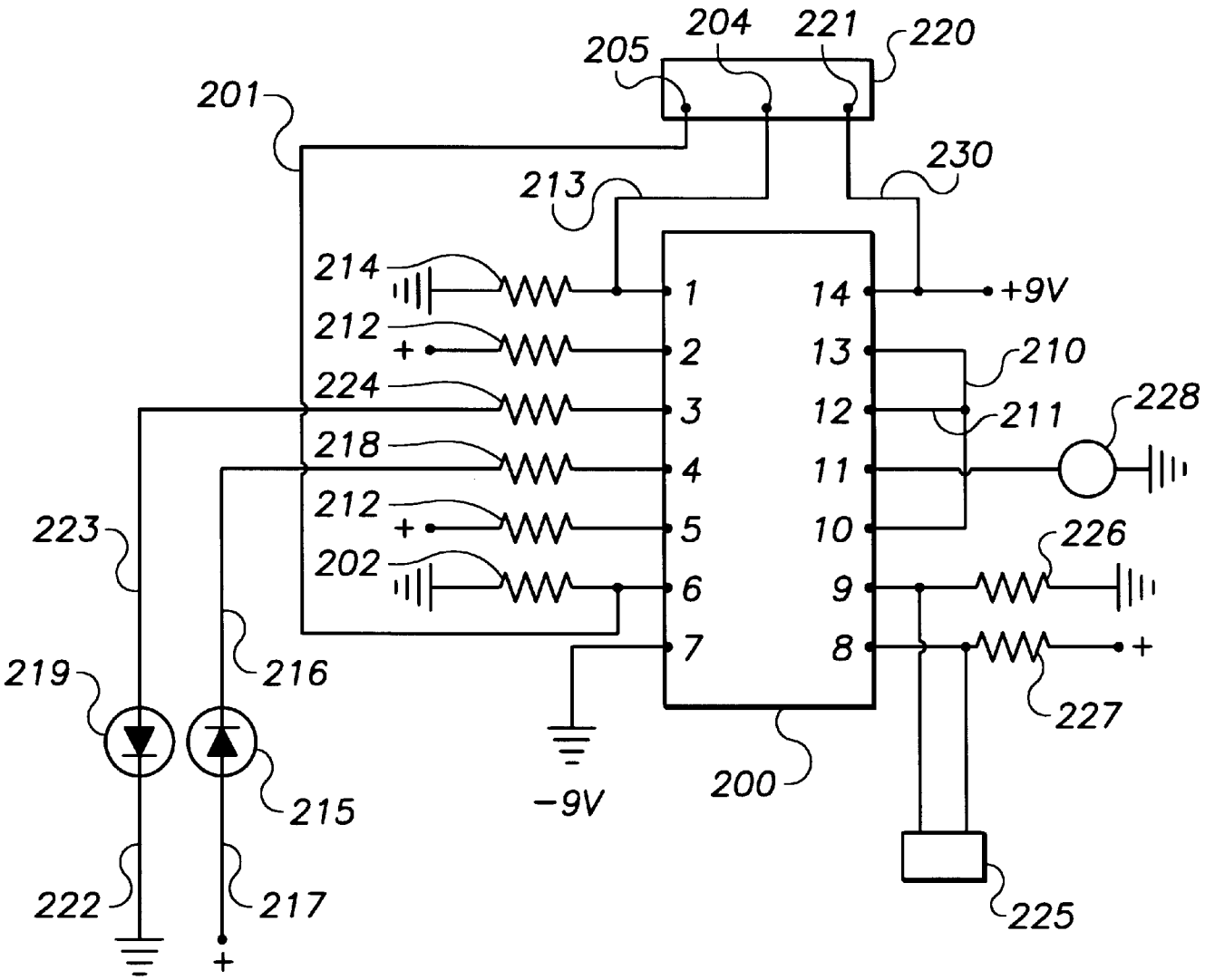
FIG. 3 is a schematic representation illustrating the elements of one embodiment of the present invention.

FIG. 3 illustrates a preferred circuit diagram for the present invention. In FIG. 4 the probe, 220, comprises a terminal, 221, a high water detector, 205, and a low water detector, 204. The operation, and relationship of the terminal, high water detector and low water detector is as described above relative to the other drawings and will not be further elaborated in reference to FIG. 4. The preferred circuitry can be suitably prepared with a CD4011 chip, 200. Terminals 10, 12 and 13 of the chip, 205, are electrically connected by leads 210, and 211. Terminals 2 and 5 are electrically connected to the positive pole of the power source, not shown, through resistors, 212. The high water detector, 205, of the probe, 220, is connected to terminal 6 of the chip, 200, by lead, 201. Terminal 6 of the chip, 200, is further grounded through a resistor, 202. The low water detector, 204, is attached to terminal 1 of the chip, 200, by lead, 213. Terminal 1 is further electrically connected to ground through resistor, 214. The high water indicator, 215, is electrically connected to terminal 4 of the chip, 200, by lead, 216, through resistor, 218, and to positive charge by lead, 217. The low water indicator, 219, is electrically connected to ground by lead, 222, and to terminal 3 of chip, 200, by lead 223, through resistor, 224. Terminals 8, 9 and 11 of the chip, 200, control the heat sensor and heat indicator portions of the preferred schematic diagram represented in FIG. 3. The heat sensor, 225, connects to terminals 8 and 9. Terminal 9 is electrically connected to ground through a resistor, 226, and terminal 8 is electrically connected to positive pole of the power supply through a resistor, 227. If the predetermined threshold temperature is exceeded the heat sensor, 225, closes the circuit between terminal 8 and 9 of the chip, 200, causing the heat indicator, 228, to alert. The resistors are preferably all ¼ watt. Resistor 202 is preferably a 470 Kohm resistor; resistors 212, 214 and 226 are preferably 1 Mohm resistors; resistors 218 and 224 are preferably 680 ohm resistors and resistor 227 is preferably a 330 ohm resistor. The heat indicator, 228, is preferably an electronic buzzer (3 to 5 volts) with a particularly suitable example being a Radio Shack #273-065. The preferred low water indicator is a light emitting diode, most preferably green, and the preferred high water indicator is a light emitting diode, most preferably red.

Power sources are well known and will not be elaborated on herein. Preferably, the power source is a battery and most preferably the power source is a 9V dry cell battery.

The preferred manner in which the invention can be practiced has been described herein. Other methods for practicing the invention may be realized by those skilled in the art without departing from the spirit of the invention as set forth in the claims.

What is claimed is:

1. A safety device for determining and reporting an amount of water in a reservoir of a potted plant comprising:

a probe in said reservoir comprising:

a low water detector capable of providing a first electrical signal when said reservoir has a water level below said low water detector; and a high water detector capable of providing a second electrical signal when said reservoir has a water level above said high water detector; and an ornament comprising:

a low water indicator capable of receiving said first electrical signal and illuminating when said first electrical signal is received and not illuminating when said electrical signal is not received; and a high water indicator capable of receiving said second electrical signal and illuminating when said second electrical signal is received.

2. The safety device of claim 1 wherein said probe comprises an elongated tube.

3. The safety device of claim 2 further comprising a first disk attached to said tube wherein said first disk comprises said low water detector.

4. The safety device of claim 2 further comprising a second disk attached to said tube wherein said second disk comprises said high water detector.

5. The safety device of claim 2 further comprising a heat sensor capable of generating an electrical signal above a predetermined temperature and an alerter capable of receiving said electrical signal and generating an alerting signal.

6. The safety device of claim 5 wherein said alerter is an audible alerter.

7. The safety device of claim 1 wherein said low water indicator or said high water indicator is a light.

8. The safety device of claim 1 wherein said low water indicator or said high water indicator is a light emitting diode.

9. A safety device for determining and reporting an amount of water in a reservoir of a potted plant comprising:

a probe in said reservoir wherein said probe comprises:

an elongated tube a low water detector attached to said tube and capable of providing a first electrical signal when said reservoir has a water level below said low water detector;

a high water detector attached to said tube and capable of providing a second electrical signal when said reservoir has a water level above said high water detector;

an ornament comprising a low water light and a high water light;

a first electrical control element capable of receiving said first electrical signal and illuminating said low water light only when said first electrical signal is received; and a second electrical control element capable of receiving said second electrical signal and illuminating said high water light.

10. The safety device of claim 9 wherein said low water light is a light emitting diode.

11. The safety device of claim 10 wherein said low water light is a green light emitting diode.

12. The safety device of claim 9 wherein said high water light is a light emitting diode.

13. The safety device of claim 12 wherein said high water light is a red light emitting diode.

14. A safety device for a potted plant comprising:

a reservoir for holding an amount of water;

an electrical control element;

a probe comprising:

an elongated tube comprising a bottom end and a top end;

a first disk attached to said tube between said bottom end and said top end;

a first detector attached to said first disk;

a first lead connecting said first detector to said electrical control element;

a second disk attached to said tube between said first disk and said top end;

a second detector attached to said second disk;

a second lead connecting said second detector to said electrical control element;

a grounding element attached to said bottom end of said tube between said first disk and said bottom end; and a third lead connecting said grounding element to said electrical control element; and an ornament comprising;

a first light in electrical connection with said electrical control element; and a second light in electrical connection with said electrical control element;

wherein if said amount of water in said reservoir is sufficient to immerse said first detector and said grounding element said first light extinguishes and if said amount of water in said reservoir is sufficient to immerse said second detector and said grounding element said second light illuminates.

* * * * *